US006641099B1

(12) United States Patent
Lue

(10) Patent No.: US 6,641,099 B1
(45) Date of Patent: Nov. 4, 2003

(54) BAIT RIGGING TOOL HOLDER SYSTEM

(76) Inventor: Suzanei Lue, 6820 Riviera Dr., Coral Gables, FL (US) 33146

( * ) Notice: Subject to any disclaimer, the term of this patent is extended or adjusted under 35 U.S.C. 154(b) by 0 days.

(21) Appl. No.: 10/054,836

(22) Filed: Jan. 23, 2002

(51) Int. Cl.[7] ..... A47B 96/06
(52) U.S. Cl. ..... 248/309.1; 248/314; 211/70.6
(58) Field of Search ..... 248/309.1, 314; 211/70.6

(56) References Cited

U.S. PATENT DOCUMENTS 2,291,381 A * 7/1942 Drake ..... 211/60
2,815,863 A * 12/1957 Larson ..... 211/60
3,076,627 A * 2/1963 Huron ..... 248/309
3,630,385 A * 12/1971 Searcy ..... 211/88
4,653,637 A * 3/1987 Wallace ..... 206/372
5,505,316 A * 4/1996 Lee ..... 211/70.6
5,641,079 A * 6/1997 Schmidt ..... 211/70.6
5,743,416 A * 4/1998 Yemini ..... 211/70.6
6,102,215 A * 8/2000 Guida ..... 211/70.6
6,202,865 B1 * 3/2001 Kuo ..... 211/70.6
6,241,208 B1 * 6/2001 Lin ..... 248/309.1

* cited by examiner

*Primary Examiner*—Leslie A. Braun
*Assistant Examiner*—Amy J. Sterling
(74) *Attorney, Agent, or Firm*—Edward P. Dutkiewicz

(57) ABSTRACT

A bait rigging tool holder system comprises a rectangular base plate. The base plate is positionable in an essentially vertical plane with upper attachment apertures and lower attachment apertures. Laterally aligned upper coupling apertures and laterally aligned lower coupling apertures are provided. A rectangular upper support plate is positionable in an essentially horizontal plane with upper coupling recesses and screws coupling the upper support plate to the base plate. A plurality of support holes extends through the base plate. Further provided is a rectangular lower support plate. The lower support plate is positionable in a horizontal plane with coupling recesses and screws coupling the lower support plate to the base plate. A plurality of coupling holes extends through the base plate.

4 Claims, 3 Drawing Sheets

FIG 1
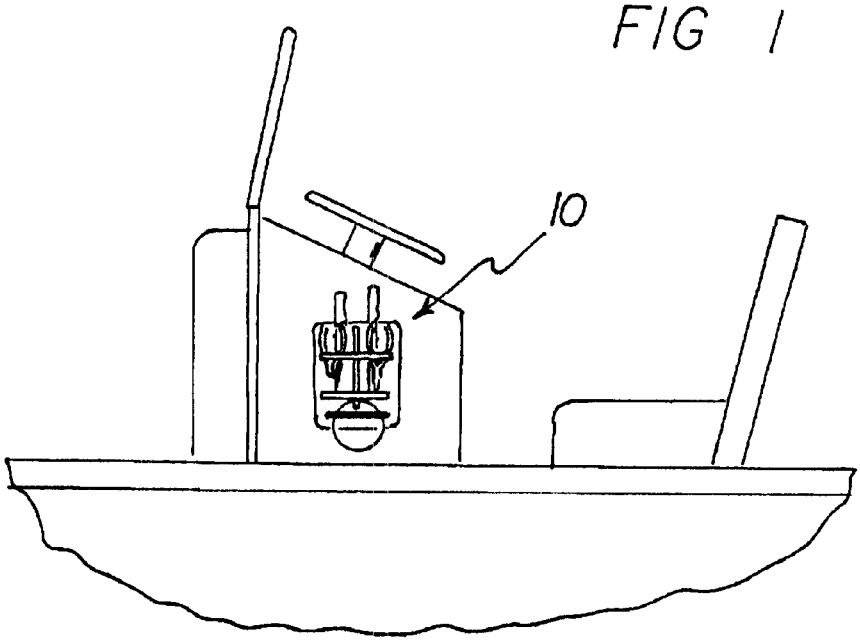
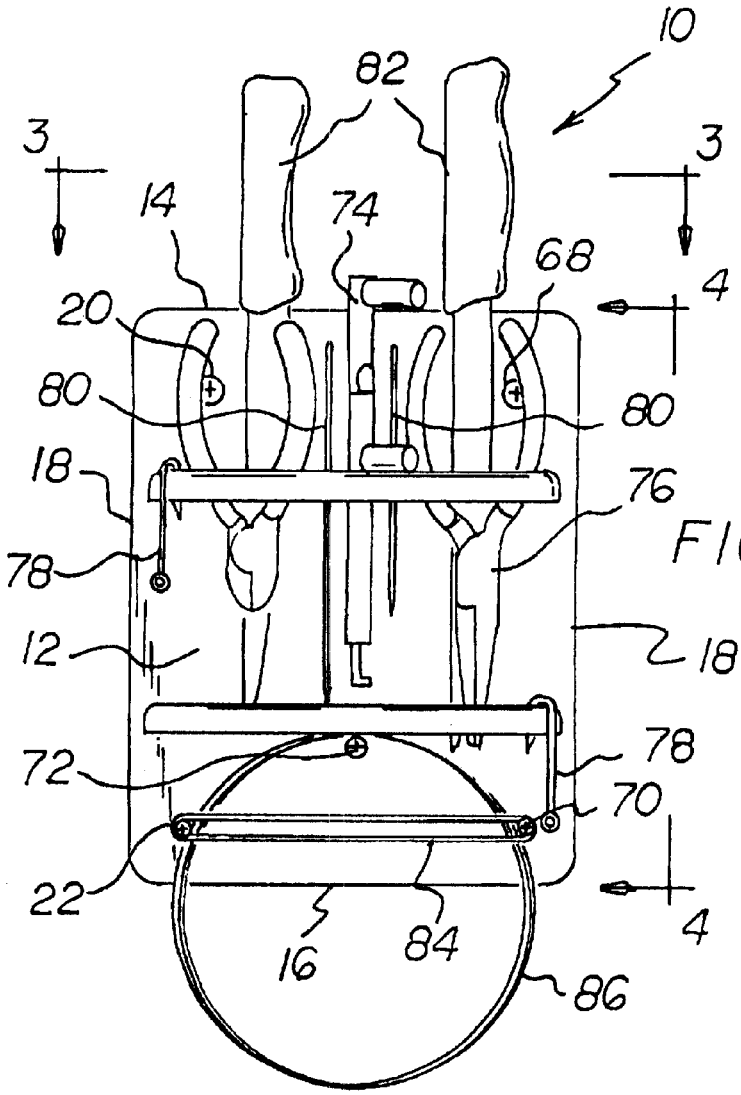
FIG 2

FIG 3
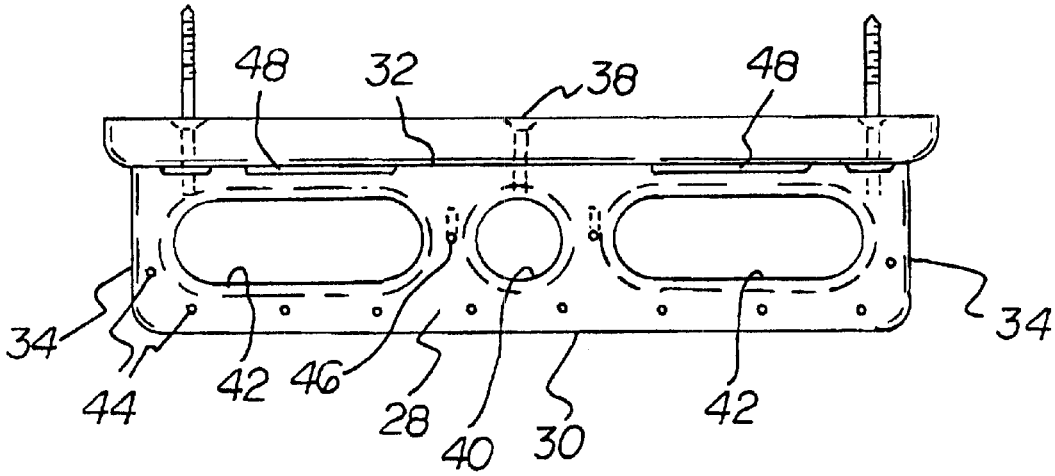
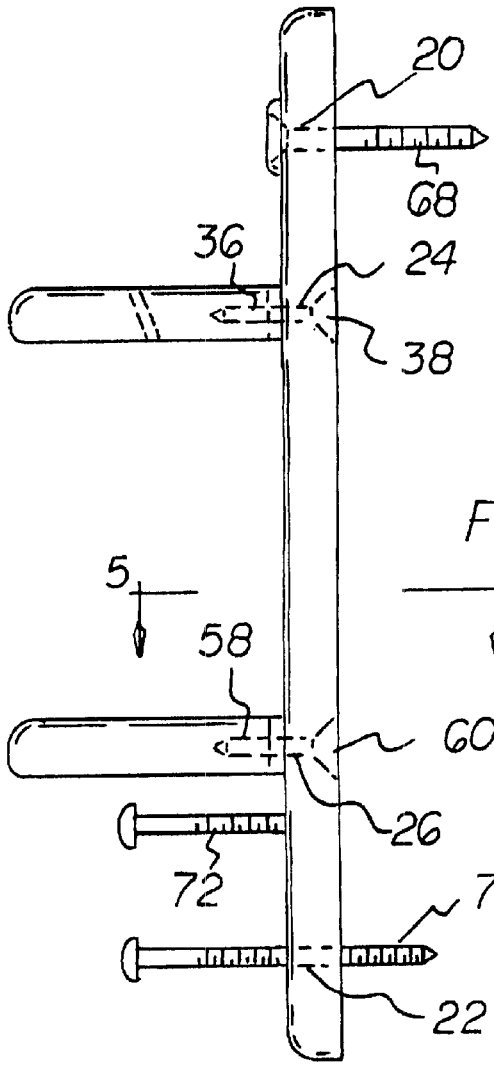
FIG 4

FIG 5
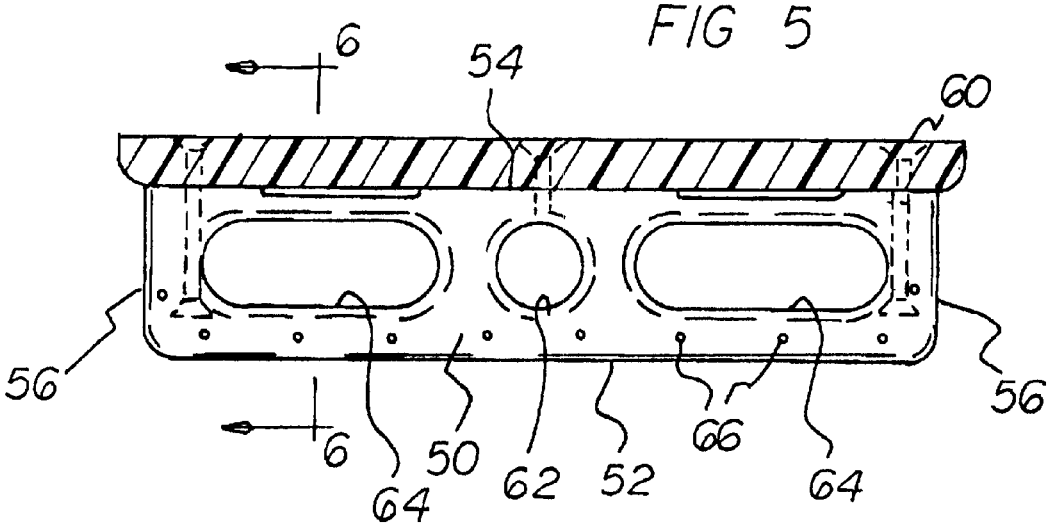
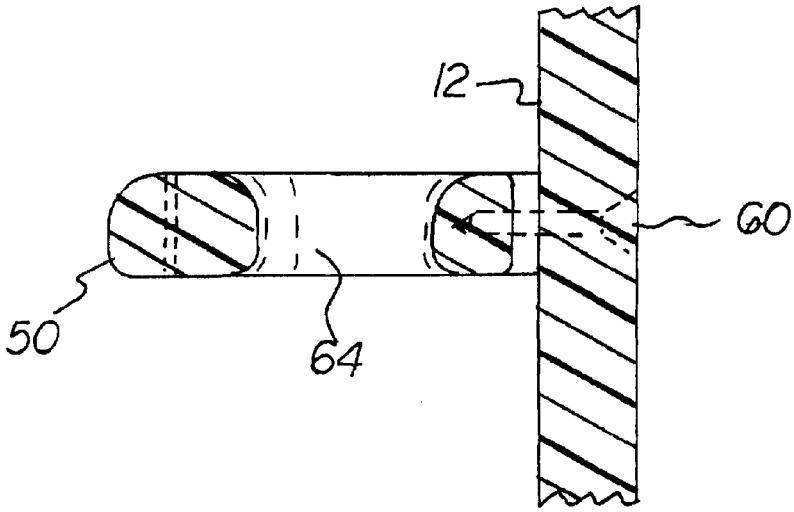
FIG 6

BAIT RIGGING TOOL HOLDER SYSTEM

BACKGROUND OF THE INVENTION

1. Field of the Invention

The present invention relates to a bait rigging tool holder system and more particularly pertains to efficiently supporting fishing-related tools for easy access.

2. Description of the Prior Art

The use of tool holders of known designs and configurations is known in the prior art. More specifically, tool holders of known designs and configurations previously devised and utilized for the purpose of organizing tools through conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,951,828 to Martin discloses a toothbrush rack device. U.S. Pat. No. 4,991,724 to Wei discloses a structure of rack assembly. U.S. Pat. No. 5,190,169 to Sincock discloses a device and method for the safe securing and disposal of sharps from medical tools. Lastly, U.S. Pat. No. 5,302,014 ro Hobson discloses a fishing kit.

While these devices fulfill their respective, particular objectives and requirements, the aforementioned patents do not describe a bait rigging tool holder system that allows efficiently supporting fishing-related tools for easy access.

In this respect, the bait rigging tool holder system according to the present invention substantially departs from the conventional concepts and designs of the prior art, and in doing so provides an apparatus primarily developed for the purpose of efficiently supporting fishing-related tools for easy access.

Therefore, it can be appreciated that there exists a continuing need for a new and improved bait rigging tool holder system which can be used for efficiently supporting fishing-related tools for easy access. In this regard, the present invention substantially fulfills this need.

SUMMARY OF THE INVENTION

In view of the foregoing disadvantages inherent in the known types of tool holders of known designs and configurations now present in the prior art, the present invention provides an improved bait rigging tool holder system. As such, the general purpose of the present invention, which will be described subsequently in greater detail, is to provide a new and improved bait rigging tool holder system and method which has all the advantages of the prior art and none of the disadvantages.

To attain this, the present invention essentially comprises a polymer board base plate. The base plate is of a generally rectilinear configuration. The base plate has an inner surface and an outer surface. The base plate is also positionable in an essentially vertical plane. The base plate has a top edge and a bottom edge and a pair of parallel side edges. In this manner four corners are formed. The base plate further has two upper attachment apertures. The upper attachment apertures are located adjacent to each of the upper corners of the base plate. The base plate also has two lower attachment apertures. The lower attachment apertures are located adjacent to each of the lower corners of the base plate. Three laterally aligned upper coupling apertures are provided. The upper coupling apertures are located about one third of the distance down from the upper edge. Three laterally aligned lower coupling apertures are provided. The lower coupling apertures are located about one third of the distance up from the lower edge. The coupling apertures are countersunk from the inner surface. A polymer board upper support plate is provided next. The upper support plate is of a generally rectilinear configuration. The upper support plate has an upper surface and an lower surface. The upper support plate is positionable in an essentially horizontal plane. The upper support plate has a front edge and a rear edge and a pair of parallel side edges. Three laterally spaced upper coupling recesses are provided in the inner edge and aligned with the upper coupling apertures and three coupling screws coupling the upper support plate to the base plate. A plurality of holes extend through the upper support plate. The plurality of holes includes a centrally located circular central hole. Also included in the plurality of holes is an oval hole on each side of the central hole and a plurality of small holes adjacent to the front and side edges. An angled hole is also included between the central hole and each of the oval holes. A pair of slots is formed in the upper support plate between the coupling screws adjacent to the base plate. Provided next is a polymer board lower support plate. The lower support plate is of a generally rectilinear configuration. The lower support plate has an upper surface and an lower surface. The lower support plate is positionable in an essentially horizontal plane. The lower support has a front edge and a rear edge and a pair of parallel side edges. Three laterally spaced lower coupling recesses are in the inner edge aligned with the lower coupling apertures. Three coupling screws couple the lower support plate to the base plate. A plurality of holes extend through the lower support plate. The plurality of holes includes a centrally located circular central hole, an oval hole on each side of the central hole, and a plurality of small holes adjacent to the front and side edges. Further provided is a pair of short upper attachment screws. The upper attachment screws extend through the upper attachment apertures. A pair of long lower attachment screws extends through the lower attachment apertures and protrudes outwardly from the exterior face of the base plate. An intermediate screw protrudes outwardly from the base plate beneath the lower plate. Provided last is a plurality of tools. The plurality of tools includes a fish hook extractor. The fish hook extractor is positioned within the central hole. A pair of pliers is positioned within the oval holes. A plurality of hooks is positioned within the small holes. A pair of sewing needles is positioned within the angled holes. A pair of knives is positioned within the slots. Elastic bands are positioned on the lower attachment screws. Leader material is positioned on the intermediate screw.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bait rigging tool holder system which has all of the advantages of the prior art tool holders of known designs and configurations and none of the disadvantages.

It is another object of the present invention to provide a new and improved bait rigging tool holder system which may be easily and efficiently manufactured and marketed.

It is further an object of the present invention to provide a new and improved bait rigging tool holder system which is of durable and reliable constructions.

An even further object of the present invention is to provide a new and improved bait rigging tool holder system which is susceptible of a low cost of manufacture with regard to both materials and labor, and which accordingly is then susceptible of low prices of sale to the consuming public, thereby making such bait rigging tool holder system economically available to the buying public.

Even still another object of the present invention is to provide a bait rigging tool holder system for efficiently supporting fishing-related tools for easy access.

Lastly, it is an object of the present invention to provide a new and improved bait rigging tool holder system comprising a rectangular base plate. The base plate is positionable in an essentially vertical plane with upper attachment apertures and lower attachment apertures. Laterally aligned upper coupling apertures and laterally aligned lower coupling apertures are provided. A rectangular upper support plate is positionable in an essentially horizontal plane with upper coupling recesses and screws coupling the upper support plate to the base plate. A plurality of support holes extends through the upper support plate. Further provided is a rectangular lower support plate. The lower support plate is positionable in a horizontal plane with coupling recesses and screws coupling the lower support plate to the base plate. A plurality of coupling holes extends through the lower support plate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a bait rigging tool system in a mounted orientation and constructed in accordance with the principles of the present invention.

FIG. 2 is an enlarged front elevational view of the system shown in FIG. 1.

FIG. 3 is a plan view of the system taken along line 3—3 of FIG. 2.

FIG. 4 is a side elevational view of the system taken along line 4—4 of FIG. 2.

FIG. 5 is cross-sectional view taken along line 5—5 of FIG. 4.

FIG. 6 is a cross-sectional view taken along line 6—6 of FIG. 5.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved bait rigging tool holder system embodying the principles and concepts of the present invention and generally designated by the reference numeral 10 will be described.

The present invention, the bait rigging tool holder system 10 is comprised of a plurality of components. Such components in their broadest context include a rectangular base plate, a rectangular upper support plate, and a rectangular lower support plate. Such components are individually configured and correlated with respect to each other so as to attain the desired objective.

First provided is a polymer board base plate 12. The base plate is of a generally rectilinear configuration. The base plate has an inner surface and an outer surface. The base plate is also positionable in an essentially vertical plane. The base plate has a top edge 14 and a bottom edge 16 and a pair of parallel side edges 18. In this manner four corners are formed. The base plate further has two upper attachment apertures 20. The upper attachment apertures are located adjacent to each of the upper corners of the base plate. The base plate also has two lower attachment apertures 22. The lower attachment apertures are located adjacent to each of the lower corners of the base plate. Three laterally aligned upper coupling apertures 24 are provided. The upper coupling apertures are located about one third of the distance down from the upper edge. Three laterally aligned lower coupling apertures 26 are provided. The lower coupling apertures are located about one third of the distance up from the lower edge. The coupling apertures are countersunk from the inner surface.

A polymer board upper support plate 28 is provided next. The upper support plate is of a generally rectilinear configuration. The upper support plate has an upper surface and an lower surface. The upper support plate is positionable in an essentially horizontal plane. The upper support plate has a front edge 30 and a rear edge 32 and a pair of parallel side edges 34. Three laterally spaced upper coupling recesses 36 are provided in the inner edge and aligned with the upper coupling apertures and three coupling screws 38 coupling the upper support plate to the base plate. A plurality of holes extend through the upper support plate. The plurality of holes includes a centrally located circular central hole 40. Also included in the plurality of holes is an oval hole 42 on each side of the central hole and a plurality of small holes 44 adjacent to the front and side edges. An angled hole 46 is also included between the central hole and each of the oval holes. A pair of slots 48 is formed in the upper support plate between the coupling screws adjacent to the base plate.

Provided next is a polymer board lower support plate 50. The lower support plate is of a generally rectilinear configuration. The lower support plate has an upper surface and an lower surface. The lower support plate is positionable in an essentially horizontal plane. The lower support has a front edge 52 and a rear edge 54 and a pair of parallel side edges 56. Three laterally spaced lower coupling recesses 58 are in the inner edge aligned with the lower coupling apertures. Three coupling screws 60 couple the lower support plate to the base plate. A plurality of holes extend through the lower support plate. The plurality of holes includes a centrally located circular central hole 62, an oval hole 64 on each side of the central hole, and a plurality of small holes 66 adjacent to the front and side edges.

Further provided is a pair of short upper attachment screws 68. The upper attachment screws extend through the upper attachment apertures. A pair of long lower attachment screws 70 extends through the lower attachment apertures and protrudes outwardly from the exterior face of the base plate. An intermediate screw 72 protrudes outwardly from the base plate beneath the lower plate.

Provided last is a plurality of tools. The plurality of tools includes a fish hook extractor 74. The fish hook extractor is positioned within the central hole. A pair of pliers is positioned within the oval holes 76. A plurality of hooks 78 is positioned within the small holes. A pair of sewing needles 80 is positioned within the angled holes. A pair of knives 82 is positioned within the slots. Elastic bands 84 are positioned on the lower attachment screws. Leader material 86 is positioned on the intermediate screw.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bait rigging tool holder system for efficiently supporting fishing-related tools for easy access comprising, in combination:

a polymer board base plate of a generally rectilinear configuration with an inner surface and an outer surface and positionable in an essentially vertical plane and having a top edge and a bottom edge and a pair of parallel side edges thereby forming four corners, the base plate have two upper attachment apertures located adjacent to each of the upper corners of the base plate, the base plate have two lower attachment apertures located adjacent to each of the lower corners of the base plate, three laterally aligned upper coupling apertures located about one third of the distance down from the upper edge, three laterally aligned lower coupling apertures located about one third of the distance up from the lower edge, the coupling apertures being countersunk from the inner surface;

a polymer board upper support plate of a generally rectilinear configuration with an upper surface and an lower surface and positionable in an essentially horizontal plane and having a front edge and a rear edge and a pair of parallel side edges, three laterally spaced upper coupling recesses in the inner edge aligned with the upper coupling apertures, and three coupling screws coupling the upper support plate to the base plate, a plurality of holes extending through the upper support plate including a centrally located circular central hole, an oval hole on each side of the central hole, a plurality of small holes adjacent to the front and side edges, and an angled hole between the central hole and each of the oval holes with a pair of slots formed in the upper support plate between the coupling screws adjacent to the base plate;

a polymer board lower support plate of a generally rectilinear configuration with an upper surface and an lower surface and positionable in an essentially horizontal plane and having a front edge and a rear edge and a pair of parallel side edges, three laterally spaced lower coupling recesses in the inner edge aligned with the lower coupling apertures, and three coupling screws coupling the lower support plate to the base plate, a plurality of holes extending through the lower support plate including a centrally located circular central hole, an oval hole on each side of the central hole, and a plurality of small holes adjacent to the front and side edges;

a pair of short upper attachment screws extending through the upper attachment apertures, a pair of long lower attachment screws extending through the lower attachment apertures and protruding outwardly from the exterior face of the base plate and an intermediate screw protruding outwardly from the base plate beneath the lower plate; and a plurality of tools including, a fish hook extractor positioned within the central hole, a pair of pliers positioned within the oval holes, a plurality of hooks positioned within the small holes, a pair of sewing needles positioned within the angled holes, a pair of knives positioned within the slots, elastic bands positioned on the lower attachment screws, and leader material positioned on the intermediate screw.

2. A bait rigging tool holder system comprising:

a rectangular base plate positionable in an essentially vertical plane with upper attachment apertures and lower attachment apertures, and with laterally aligned upper coupling apertures and laterally aligned lower coupling apertures;

a rectangular upper support plate positionable in an essentially horizontal plane with laterally spaced upper coupling recesses in an inner edge aligned with the upper coupling apertures and coupling screws coupling the upper support plate to the base plate and a plurality of round and oval support holes extending through the upper support plate; and a rectangular lower support plate positionable in an essentially horizontal plane with laterally spaced lower coupling recesses in an inner edge aligned with the lower coupling apertures and coupling screws coupling the lower support plate to the base plate and a plurality of round and oval support holes extending through the lower support plate wherein the support holes in the upper and lower plates include a centrally located circular central hole, an oval hole on each side of the central hole, and a plurality of small holes adjacent to the front and side edges; and further including in the upper plate an angled hole between the central hole and each of the oval holes with a pair of slots formed in the upper support plate between the coupling screws adjacent to the base plate.

3. The system as set forth in claim 2 and further including a pair of short upper attachment screws extending through the upper attachment apertures, a pair of long lower attachment screws extending through the lower attachment apertures and protruding outwardly from the exterior face of the base plate and an intermediate screw protruding outwardly from the base plate beneath the lower plate.

4. The system as set forth in claim 3 and further including a plurality of tools including, a fish hook extractor positioned within the central hole, a pair of pliers positioned within the oval holes, a plurality of hooks positioned within the small holes, a pair of sewing needles positioned within the angled holes, a pair of knives positioned within the slots, elastic bands positioned on the lower attachment screws, and leader material positioned on the intermediate screw.

* * * * *